US009093081B2

(12) United States Patent
Laperdon et al.

(10) Patent No.: US 9,093,081 B2
(45) Date of Patent: Jul. 28, 2015

(54) METHOD AND APPARATUS FOR REAL TIME EMOTION DETECTION IN AUDIO INTERACTIONS

(71) Applicant: NICE-SYSTEMS LTD, Ra'anana (IL)

(72) Inventors: Ronen Laperdon, Modiin (IL); Moshe Wasserblat, Makabim (IL); Tzach Ashkenazi, Petach-Tikva (IL); Ido David David, Rishon le Zion (IL); Oren Pereg, Amikam (IL)

(73) Assignee: NICE-SYSTEMS LTD, Ra'anana (IL)

( * ) Notice: Subject to any disclaimer, the term of this patent is extended or adjusted under 35 U.S.C. 154(b) by 264 days.

(21) Appl. No.: 13/792,082

(22) Filed: Mar. 10, 2013

(65) Prior Publication Data

US 2014/0257820 A1 Sep. 11, 2014

(51) Int. Cl.
*G10L 25/63* (2013.01)

(52) U.S. Cl.
CPC ..... *G10L 25/63* (2013.01)

(58) Field of Classification Search
None
See application file for complete search history.

(56) References Cited

U.S. PATENT DOCUMENTS

2008/0040110 A1* 2/2008 Pereg et al. ..... 704/236
2013/0030812 A1* 1/2013 Kim ..... 704/270

* cited by examiner

*Primary Examiner* — Jeremiah Bryar
(74) *Attorney, Agent, or Firm* — Soroker-Agmon

(57) ABSTRACT

The subject matter discloses a computerized method for real time emotion detection in audio interactions comprising: receiving at a computer server a portion of an audio interaction between a customer and an organization representative, the portion of the audio interaction comprises a speech signal; extracting feature vectors from the speech signal; obtaining a statistical model; producing adapted statistical data by adapting the statistical model according to the speech signal using the feature vectors extracted from the speech signal; obtaining an emotion classification model; and producing an emotion score based on the adapted statistical data and the emotion classification model, said emotion score represents the probability that the speaker that produced the speech signal is in an emotional state.

16 Claims, 8 Drawing Sheets

[M1 ...M12 M13...M23 M24...M33] [M1 ...M12 M13...M23 M24...M33] ... [M1 ...M12 M13...M23 M24...M33]

GAUSS 1 GAUSS 2 GAUSS P

FIG. 6A

| | | | | | |
|---|---|---|---|---|---|
| [600] ORDINAL RT-BUFFER ROW | 1 | [606] 2 | 3 | 4 | 5 |
| [602] RT-BUFFER EMOTION SCORE ROW | 18 | [608] 78 | 85 | 71 | 20 |
| [604] TIME TAGS ROW [MS] | 0-4000 | [610] 4001–8000 | 8001– 12000 | 12001-16000 | 16001-20001 |

FIG. 6B

METHOD AND APPARATUS FOR REAL TIME EMOTION DETECTION IN AUDIO INTERACTIONS

FIELD OF THE INVENTION

The present invention relates to interaction analysis in general, and to a method and apparatus for real time emotion detection in audio interactions, in particular.

BACKGROUND

Large organizations, such as commercial organizations or financial organizations conduct numerous audio interactions with customers, users or other persons on a daily basis. Some of these interactions are vocal, such as telephone or voice over IP conversations, or at least comprise a vocal component, such as an audio part of a video or face-to-face interaction.

Many organizations record some or all of the interactions, whether it is required by law or regulations, for business intelligence, for quality assurance or quality management purposes, or for any other reason. Once the interactions are recorded and also during the recording, the organization may want to extract as much information as possible from the interactions. The information is extracted and analyzed in order to enhance the organization's performance and achieve its business objectives. A major objective of business organizations that provide service is to provide excellent customer satisfaction and prevent customer attrition. Measurements of negative emotions that are conveyed in customer's speech serve as key performance indicator of customer satisfaction. In addition, handling emotional responses of customers to service provided by organization representatives increases customer satisfaction and decreases customer attrition.

Various prior art systems and methods enable post interaction emotion detection, that is, detection of customer emotions conveyed in speech after the interaction was terminated, namely off-line emotion detection. For example, U.S. Pat. No. 6,353,810 and U.S. patent application Ser. No. 11/568,048 disclose methods for off-line emotion detection in audio interactions. Those systems and methods are based on prosodic features, in which the main feature is the speaker's voice fundamental frequency. In those systems and methods emotional speech is detected based on large variations of this feature in speech segments.

The '048 patent application discloses the use of a learning phase in which the "neutral speech" fundamental frequency variation is estimated and then used as the basis for later segments analysis. The learning phase may be performed by using the audio from the entire interaction or from the beginning of the interaction, which makes the method not suitable for real time emotion detection.

Another limitation of such systems and methods is that they require separate audio streams for the customer side and for the organization representative side and provide very limited performance in terms of emotion detection precision and recall in case that they are provided with a single audio stream, that includes both the customer and the organization representative as input, which is common in many organizations.

However the detection and handling of emotions of customers of the organization in real time, while the conversation is taking place, serves as a major contribution for customer satisfaction enhancement.

There is thus a need in the art for method and apparatus for real time emotion detection. Such analysis enables detecting, handling and enhancing customer satisfaction.

SUMMARY OF THE INVENTION

The detection and handling of customer emotion in real time, while the conversation is taking place, serves as a major contribution for customer satisfaction enhancement and customer attrition prevention.

An aspect of an embodiment of the disclosed subject matter, relates to a system and method for real time emotion detection, based on adaptation of a Gaussian Mixture Model (GMM) and classification of the adapted Gaussian means, using a binary class or multi class classifier. In case of a binary class classifier, the classification target classes may be, for example, "emotion speech" class and "neutral speech" class.

A general purpose computer serves as a computer server executing an application for real time analysis of the interaction between the customer and the organization. The server receives the interaction portion by portion, whereas, each portion is received every predefined time interval. The general purpose computer extracts features from each interaction portion. The extracted features may include, for example, Mel-Frequency Cepstral Coefficients (MFCC) and their derivatives. Upon every newly received interaction portion, the server performs maximum a posteriori probability (MAP) adaptation of a previously trained GMM using the extracted features. The previously trained GMM is referred to herein as Universal Background Model (UBM). The means of the Gaussians of the adapted GMM are extracted and used as input vector to an emotion detection classifier. The emotion detection classifier may classify the input vector to the "emotion speech" class or to the "neutral speech" class. The emotion detection classifier uses a pre-trained model and produces a score. The score represents probability estimation that the speech in local RT-buffer is an emotional speech.

The use of MAP adapted means of a pre-trained GMM as input to a classifier enables the detection of emotional events in relatively small time frames of speech, for example time-frames of 1-4 seconds. The advantage stems from the fact that adapting a pre-trained GMM requires a relatively small set of training samples that can be extracted from a relatively small time frame of speech. As opposed to training a model from scratch which requires a relatively large set of training samples that must be extracted from a relatively large time frame of speech. The contentment in a relatively small time frame of speech makes the method suitable for RT emotion detection.

BRIEF DESCRIPTION OF THE DRAWINGS

The present disclosure will be understood and appreciated more fully from the following detailed description taken in conjunction with the drawings in which corresponding or like numerals or characters indicate corresponding or like components. Unless indicated otherwise, the drawings provide exemplary embodiments or aspects of the disclosure and do not limit the scope of the disclosure. In the drawings:

FIG. 6A shows a means vector data structure according to exemplary embodiments of the disclosed subject matter;

FIG. 6B shows an emotion flow vector data structure according to exemplary embodiments of the disclosed subject matter;

DETAILED DESCRIPTION

Figure 1:
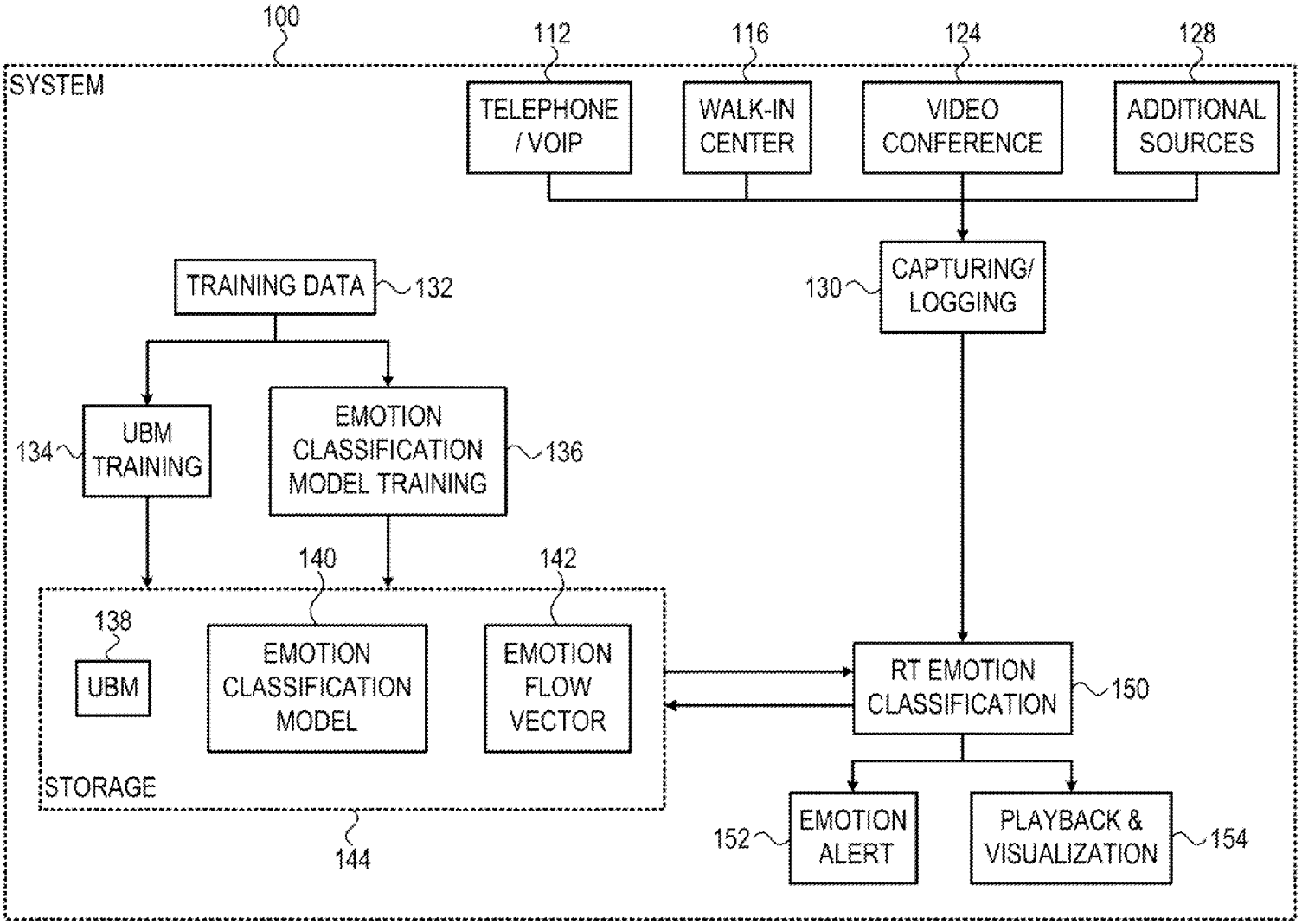
FIG. 1 shows a typical environment in which the disclosed method is used, according to exemplary embodiments of the disclosed subject matter.

Reference is made to FIG. 1 which shows a system 100 which is an exemplary block diagram of the main components in a typical environment in which the disclosed method is used, according to exemplary embodiments of the disclosed subject matter;

As shown, the system 100 may include a capturing/logging component 132 that may receive input from various sources, such as telephone/VoIP module 112, walk-in center module 116, video conference module 124 or additional sources module 128. It will be understood that the capturing/logging component 130 may receive any digital input produced by any component or system, e.g., any recording or capturing device. For example, any one of a microphone, a computer telephony integration (CTI) system, a private branch exchange (PBX), a private automatic branch exchange (PABX) or the like may be used in order to capture audio signals.

As further shown, the system 100 may include training data 132, UBM training component 134, emotion classification model training component 136, a storage device 144 that stores UBM 138, emotion classification model 140 and emotion flow vector 142. The system 100 may also include a RT emotion classification component 150. As shown, the output of the online emotion classification component may be provided to emotion alert component 152 and/or to playback & visualization component 154.

A typical environment where a system according to the invention may be deployed may be an interaction-rich organization, e.g., a contact center, a bank, a trading floor, an insurance company or any applicable financial or other institute. Other environments may be a public safety contact center, an interception center of a law enforcement organization, a service provider or the like.

Interactions captured and provided to the system 100 may be any applicable interactions or transmissions, including interactions with customers or users or interactions involving organization members, suppliers or other parties.

Various data types may be provided as input to the system 100. The information types optionally include auditory segments, video segments and additional data. The capturing of voice interactions, or the vocal or auditory part of other interactions, such as video, may be of any form, format, and may be produced using various technologies, including trunk side, extension side, summed audio, separate audio, various encoding and decoding protocols such as G729, G726, G723.1, and the like.

The interactions may be provided by modules telephone/VOIP 112, walk-in center 116, video conference 124 or additional sources module 128. Audio interactions may include telephone or voice over IP (VoIP) sessions, telephone calls of any kind that may be carried over landline, mobile, satellite phone or other technologies. It will be appreciated that voice messages are optionally captured and processed as well, and that embodiments of the disclosed subject matter are not limited to two-sided conversations. Captured interactions may include face to-face interactions, such as those recorded in a walk-in-center, video conferences that include an audio component or any additional sources of data as shown by the additional sources module 128. The additional sources module 128 may include vocal sources such as microphone, intercom, vocal input by external systems, broadcasts, files, streams, or any other source.

Data from all the above-mentioned sources and others may be captured and/or logged by the capturing/logging component 130. Capturing/logging component 130 may include a set of double real-time buffers (RT-buffers). For example, a couple of RT-buffers may be assigned to each captured interaction or each channel. Typically, an RT-buffer stores data related to a certain amount of seconds, for example, an RT-buffer may store 4 seconds of real-time digitally recorded audio signal provided by one of the modules 112, 116, 124 or 128.

The RT-buffer may be a dual audio stream, for example, a first audio stream may contain the representative side and a second audio stream may contain the customer side. RT-buffers may be used for real time analysis including real time emotion detection. In order to maintain low real time delay, RT-buffers are preferably sent for analysis within a short period, typically several milliseconds from their filling completion. The double buffer mechanism may be arranged in a way that enables the filling of the second buffer while the first buffer is being transferred for analysis by the RT emotion classification component 150. In some configurations, an RT-buffer may be allowed a predefined time for filling and may be provided when the predefined time lapses. Accordingly, an RT-buffer may be provided for processing every predefined period of time thus the real-time aspect may be maintained as no more than a predefined time interval is permitted between portions of data provided for processing by the system. For example, a delay of no more than 4 seconds may be achieved by allowing no more than 4 seconds of filling time for an RT-buffer. Accordingly, using two RT-buffers and counting time from zero, the first RT-buffer may be used for storing received audio signals during the first 4 seconds (0-4). In the subsequent 4 seconds (4-8), content in the first RT-buffer may be provided to a system while received audio signals are stored in the second RT-buffer. In the next 4 seconds (8-12) content in the second RT-buffer may be provided to a system while received audio signals are stored in the first RT-buffer and so on.

The capturing/logging component 130 may include a computing platform that may execute one or more computer applications, e.g., as detailed below. The captured data may optionally be stored in storage device 144. The storage device 144 is preferably a mass storage device, for example an optical storage device such as a CD, a DVD, or a laser disk; a magnetic storage device such as a tape, a hard disk, Storage Area Network (SAN), a Network Attached Storage (NAS), or others; a semiconductor storage device such as Flash device, memory stick, or the like.

The storage device 144 may be common or separate for different types of captured segments of an interaction and different types of additional data. The storage may be located onsite where the segments or some of them are captured, or in a remote location. The capturing or the storage components can serve one or more sites of a multi-site organization. The storage device 144 may also store UBM 138, emotion classification model 140 and emotion flow vector 142.

In an embodiment, the training data 132 may consist of a collection of pairs where each pair consists of an audio interaction and its labeling vector. The labeling vector includes a class label for each time frame of the interaction. Class labels may be, for example "emotional speech" and "neutral speech".

As further shown, the system 100 may also include the UBM training component 134 and the emotion classification model training component 136. The UBM training component may use data in training data 132 in order to generate the UBM 138. The emotion classification model training component 136 may use data in training data 132 in order to generate the emotion classification model 140. The emotion classification model may include any representation of distance between neutral speech and emotional speech. The emotion classification model may include any parameters that may be used for scoring each speech frame of an interaction in relation to the probability for emotional presence in the speech frame of the interaction.

The RT emotion classification component 150 may produces an RT-buffer emotion score for each RT-buffer. Each RT-buffer emotion score is stored in the emotion flow vector 142. In addition to the RT-buffer emotion score a global emotion score is also produced. The global emotion score is produced based on the current and previous RT-buffer emotion scores that are retrieved from the emotion flow vector 142.

The output of the emotion classification component 150 may preferably be sent to emotion alert component 152. This module generates an alert based on the global emotion scores. The alert can be transferred to contact center supervisors or managers or to organization employees by popup application, email, SMS or any other communication way. The alert mechanism is configurable by the user. For example, the user can configure a predefined threshold. The predefined threshold is compared against the global emotion scores. In case that the global emotion scores is higher than the predefined threshold alert is issued.

The output of the emotion classification component 150 may also be transferred to the playback & visualization component 154, if required. RT-buffer emotion score and/or the global emotion scores can also be presented in any way the user prefers, including for example various graphic representations, textual presentation, table presentation, vocal representation, or the like, and can be transferred in any required method.

The output can also be presented as real time emotion curve. The real time emotion curve may be plotted as the interaction is taking place, in real time. Each point of the real time emotion score curve may represent a different RT-buffer emotion score. The application may be able to present a plurality of real time emotion score curves, one curve per organization representative.

The output can also be presented as a dedicated user interface or media player that provides the ability to examine and listen to certain areas of the interactions, for example: areas of high global emotion scores.

The system 100 may include one or more computing platforms, executing components for carrying out the disclosed steps. The system 100 may be or may include a general purpose computer such as a personal computer, a mainframe computer, or any other type of computing platform that may be provisioned with a memory device (not shown), a CPU or microprocessor device, and several I/O ports (not shown).

The system 100 may include one or more collections of computer instructions, such as libraries, executables, modules, or the like, programmed in any programming language such as C, C++, C#, Java or other programming languages, and/or developed under any development environment, such as .Net, J2EE or others.

Alternatively, methods described herein may be implemented as firmware ported for a specific processor such as digital signal processor (DSP) or microcontrollers, or may be implemented as hardware or configurable hardware such as field programmable gate array (FPGA) or application specific integrated circuit (ASIC). The software components may be executed on one platform or on multiple platforms wherein data may be transferred from one computing platform to another via a communication channel, such as the Internet, Intranet, Local area network (LAN), wide area network (WAN), or via a device such as CD-ROM, disk on key, portable disk or others.

Figure 2:
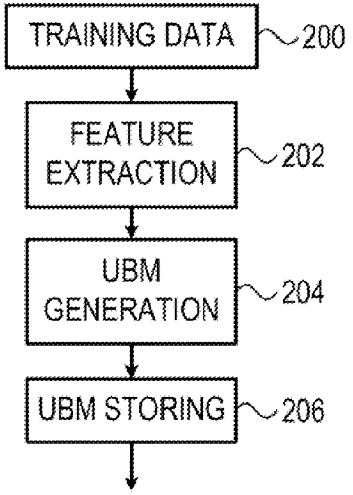
FIG. 2 shows a method for Universal Background Model (UBM) generation, according to exemplary embodiments of the disclosed subject matter.

Reference is made to FIG. 2 which shows a method for Universal Background Model (UBM) generation, according to exemplary embodiments of the disclosed subject matter.

Training data 200 consists of a collection of audio signals of interactions of different speakers. A typical collection size may be for example, five hundred interactions of average length of five minutes per interaction.

Step 202 discloses feature extraction of features such as Mel-Frequency Cepstral (MFC) coefficients and their derivatives. The concatenated MFC coefficients and their derivatives are referenced herein as feature vector. A plurality of feature vectors are extracted from the audio signals of interactions that are part of the training data 200. In some embodiments, one feature vector is typically extracted from overlapping frames of 25 milliseconds of the audio signal. A typical feature vector may include 33 concatenated coefficients in the following order: 12 MFC coefficients, 11 delta MFC coefficients and 10 delta-delta MFC coefficients, all concatenated. In other embodiments the feature vector may include Cepstral coefficients or Fourier transform coefficients.

Step 204 discloses UBM generation. The UBM which is a statistical model may be a statistical representation of a plurality of feature vectors that are extracted from a plurality of audio interactions that are part of the training data 200. The UBM may typically be a parametric Gaussian Mixture Model (GMM) of order 256. e.g., include 256 Gaussians where each Gaussian is represented in the model by three parameters: its weight, its mean and its variance. The three parameters may be determined by using the feature vectors extracted at feature extraction step 202. The GMM parameters may be determined by applying known in the art algorithms such as the K-means or the Expectation-maximization on the feature vectors extracted at feature extraction step 202.

Step 206 discloses UBM storing. At this the UBM is stored in any permanent storage, such the storage device 144 of FIG. 1.

Figure 3A:
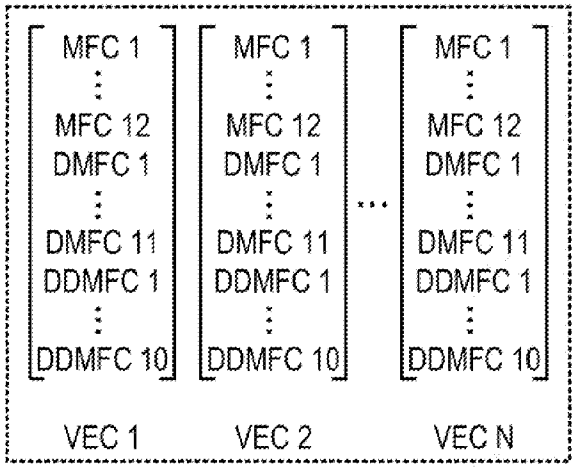
FIG. 3A shows plurality of feature vectors data structure according to exemplary embodiments of the disclosed subject matter.

Reference is made to FIG. 3A which shows plurality of feature vectors data structure according to exemplary embodiments of the disclosed subject matter. The plurality of feature vectors data structure relates to the output of feature extraction step 202 of FIG. 2. The plurality of feature vectors are typically extracted from the audio signals of interactions that are part of the training data 200 of FIG. 2. or from other audio signals. As shown, the plurality of feature vectors may include N vectors. Each feature vector may consist of a total of 33 entries which include 12 MFC coefficients, 11 delta MFC (DMFC) coefficients and 10 delta-delta MFC (DDMFC) coefficients The DMFC coefficients are produced by the derivation of the MFC coefficients and the DDMFC coefficients are produced by the derivation of the DMFC coefficients.

Figure 3B:
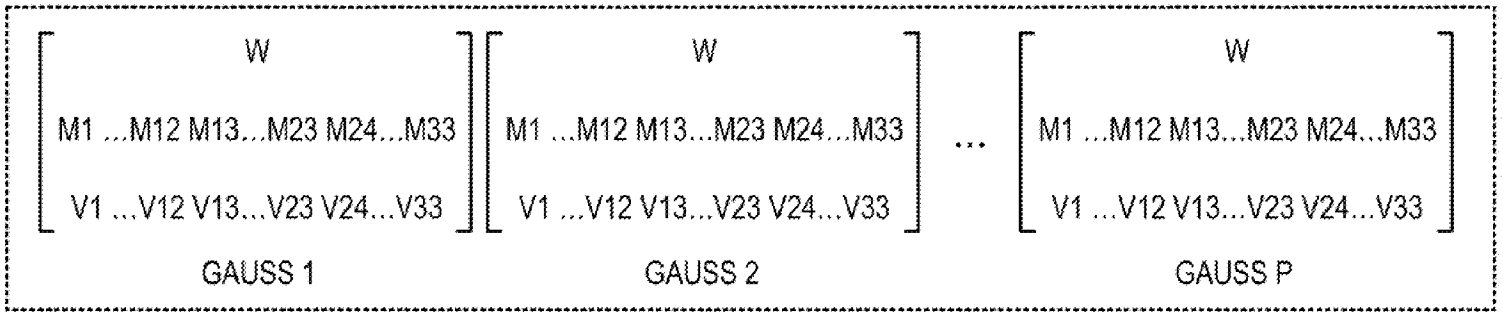
FIG. 3B shows a UBM data structure according to exemplary embodiments of the disclosed subject matter.
Figure 4:
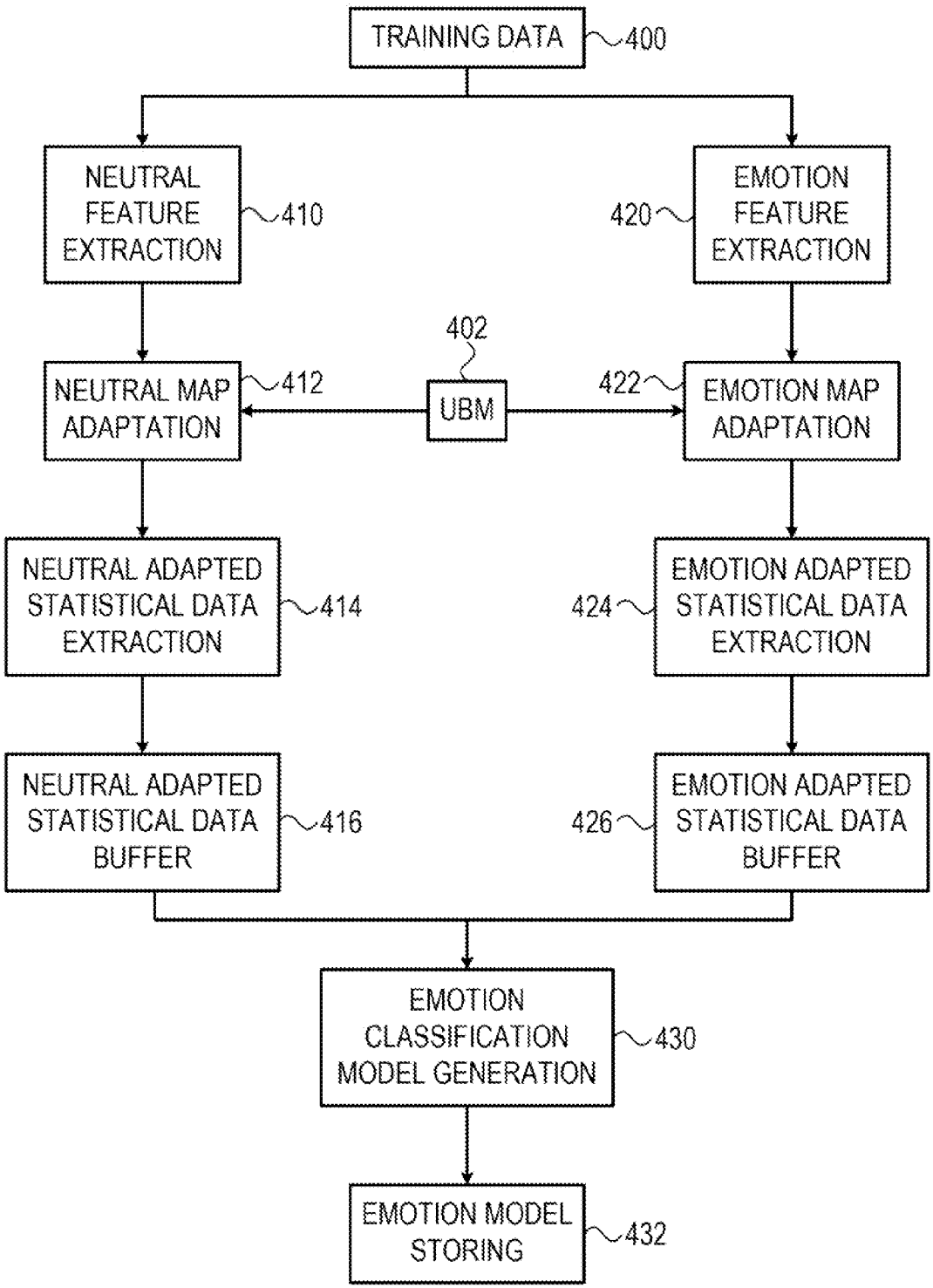
FIG. 4 shows a method for emotion classification model generation, according to exemplary embodiments of the disclosed subject matter.

Reference is made to FIG. 3B which shows a UBM data structure according to exemplary embodiments of the disclosed subject matter. As shown by FIG. 3B the UBM data structure may consist of P Gaussians, where P is typically 512. As further shown W represents a Gaussian weight, (M1 . . . M33) represent Gaussian means vector, the Gaussian means vector may consist of a total of 33 entries. The first 12 entries (M1 . . . M12), represent the means of the 12 MFC coefficients, the next 11 entries (M13 . . . M23), represent the means of the 11 delta MFC coefficients and the last 10 entries (M24 . . . M33), represent the means of the delta-delta MFC coefficients. (V1 . . . V33) represent the Gaussian variances vector, similarly to the Gaussian means vector, the Gaussian variances vector may consist of a total of 33 entries. The first 12 entries (V1 . . . V12), represent the variances of the 12 MFC coefficients, the next 11 entries (V13 . . . V23), represent the variances of the 11 delta MFC coefficients and the last 10 entries (V24 . . . V33), represent the variances of the delta-delta MEC coefficients Reference is made to FIG. 4 which shows a method for emotion classification model generation, according to exemplary embodiments of the disclosed subject matter.

Training data 400 consists of a collection of pairs where each pair consists of a speech signal of an audio interaction and its labeling vector. The labeling vector includes a class label for each portion of the interaction. Class labels may be, for example "emotional speech" and "neutral speech". Thus, an audio signal of an interaction that is part of the training data 400 may include several portions that are labeled as "emotional speech" and several portions that are labeled as "neutral speech". In addition to the label, each portion of an audio signal of an interaction is associated also with its start time and end time, measured in milliseconds from the beginning of the interaction. The labeling vector may be produced by one or more human annotators. The human annotators listen to the audio interaction and set the labels according to their subjective judgment of each portion of each audio interaction.

UBM 402 is the UBM generated and stored on steps 204 and 206 respectively, of FIG. 2. The UBM 402 data structure is illustrated at FIG. 3B.

Step 410 discloses feature extraction from the portions of audio signals of interactions that are labeled as "neutral speech". Similarly to step 202 of FIG. 2, the extracted features may be for example, Mel-frequency Cepstral (MFC) coefficients and their first and second derivatives. The concatenated MFC coefficients and their first and second derivatives are referenced herein as feature vector.

Each portion of the audio signal that is labeled as "neutral speech" is divided into super frames. Typically, the super frame length is of four seconds. A feature vector is typically extracted from overlapping frames of 25 milliseconds of each super frame, thus, producing a plurality of feature vectors that are associated with each super frame. An illustration of the data structure of the plurality of feature vectors is shown in FIG. 3A.

Step 412 discloses neutral MAP adaptation of the UBM 402 according to the features that are extracted on step 410. The MAP adaptation of the UBM 402 is performed multiple times, once for each plurality of feature vectors that are associated with each super frame generated on step 410 thus producing a plurality of neutral adapted UBM's. The parameters of the UBM 402 are adapted based on the said plurality of feature vectors. The adaptation is typically performed on the means of the Gaussians that constitute the UBM 402. The MAP adaptation may be performed by recalculating the UBM Gaussian means using the following weighted average formula:

$$\mu_{adapted}(m) = \left( \frac{\sigma \cdot \mu_0(m) + \sum_n w(m) \cdot x(n)}{\sigma + \sum_n w(m)} \right)$$

Wherein: $\mu_{adopted}(m)$ may represent the adapted means value the m-th Gaussian; n may represent the number of feature vectors extracted from the super frame;

$\mu_0(m)$ may represent the original means value of the UBM;

$\sigma$ may represent the adaptation parameter that controls the balance between the original means value and the adapted means value. $\sigma$ may typically be in the range of 2-20;

w(m) may represent original Gaussian weight value of the UBM; and x(n) may represent the n-th the feature vector extracted from the super frame.

Step 414 discloses neutral adapted statistical data extraction from each adapted statistical model that is produced on step 412. A neutral adapted statistical data is extracted from each adapted UBM that is associated with each super frame, thus producing a plurality of neutral adapted statistical data. In some embodiments, each neutral adapted statistical data is extracted by extracting the adapted Gaussian means from a single adapted UBM producing a means vector.

Step 416 discloses storing the plurality of neutral adapted statistical data in a neutral adapted statistical data buffer.

Step 420 discloses feature extraction from the portions of audio signals of interactions that are labeled as "emotional speech". Each portion of the audio signal that is labeled as "emotional speech" is divided into super frames. The feature extraction and super frame division is performed similarly to step 410.

Step 422 discloses emotion MAP adaptation of the UBM 402 according to the features that are extracted on step 420. The MAP adaptation of the UBM 402 is performed multiple times, once for each plurality of feature vectors that are associated with each super frame generated on step 420 410 thus producing a plurality of emotion adapted UBM's. The adaptation process of the UBM 402 is similar to the adaptation process performed on step 412.

Step 424 discloses emotion adapted statistical data extraction from each adapted statistical model that is produced on step 422. An emotion adapted statistical data is extracted from each adapted UBM that is associated with each super frame, thus producing a plurality of emotion adapted statistical data. In some embodiments, each emotion adapted statistical data is extracted by extracting the adapted Gaussian means from a single adapted UBM producing a means vector.

Step 426 discloses storing the emotion adapted statistical data in an emotion adapted statistical data buffer.

Step 430 discloses emotion classification model generation. The emotion classification model is trained using the plurality of neutral adapted statistical data that is stored in the neutral adapted statistical data buffer and the adapted statistical data that are stored in the emotion adapted statistical data buffer. Training is preferably performed using methods such as neural networks or Support Vector Machines (SVM). Assuming for example, the usage of a linear classification method such as SVM. Further assuming that the classifier operates in a binary class environment—where the first class is a "neutral speech" class and the second class is an "emotional speech" class. In this case the training process aims to produce a linear separation between the two classes using the plurality of neutral adapted statistical data as training data for the "neutral speech" class and the plurality of emotion adapted statistical data as training data for the "emotional speech" class. In the case of SVM the main training process includes the selection of specific neutral adapted statistical data and specific emotion adapted statistical data that are close to the separation hyper plane. Those vectors are called support vectors. The output of the training process, and of this step, is an emotion classification model which includes the support vectors.

Step 432 discloses emotion classification model storing. The model is stored in any permanent storage, such as emotion classification model 140 of FIG. 1. in storage device 144 of FIG. 1.

Figure 5:
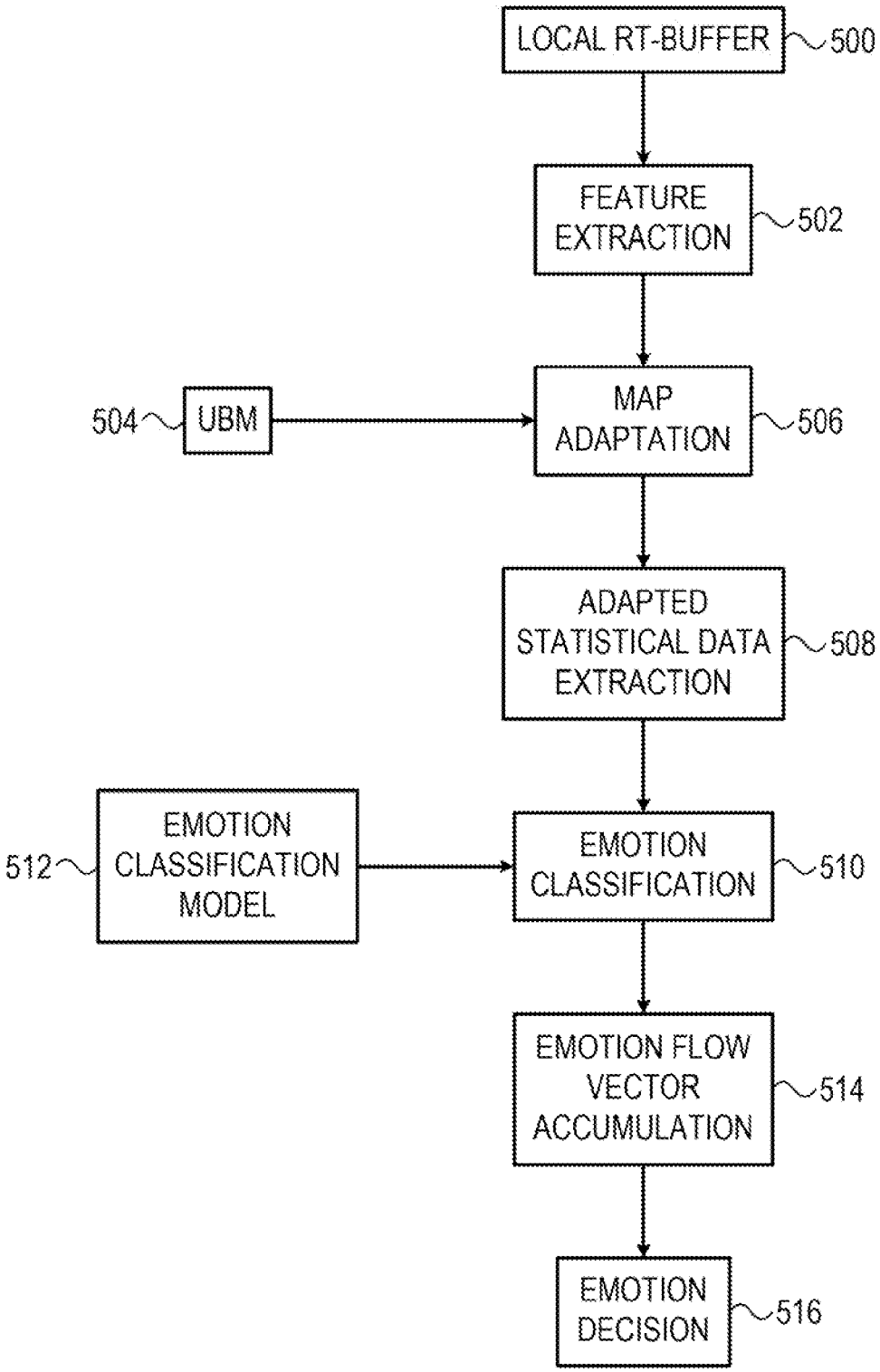
FIG. 5 shows a method for real time emotion classification, according to exemplary embodiments of the disclosed subject matter.

Reference is made to FIG. 5 which shows a method for real time emotion classification, according to exemplary embodiments of the disclosed subject matter.

Local RT-buffer 500 contains the input audio signal to the system and is a copy of the transferred content of an RT-buffer from capturing/logging component 130 of FIG. 1. Typically, a system may receive a new RT-buffer immediately upon buffer filling completion by the audio capturing/logging component 130 of FIG. 1. The audio signal in RT-buffer is a portion of audio signal of an interaction between a customer and an organization representative. A typical local RT-buffer may contain four seconds of audio signal.

Step 502 discloses feature extraction of features such as Mel-frequency Cepstral coefficients (MFCC) and their derivatives. Said features are extracted from the audio signal in local RT-buffer 500. Feature extraction step 502 is performed similarly to neutral feature extraction step 410 of FIG. 4. and emotion feature extraction step 420 of FIG. 4. An illustration of the data structure of the features extracted on this step is shown in FIG. 3A.

UBM 504 is the UBM that is generated and stored on steps 204 and 206 of FIG. 2.

Step 506 discloses MAP adaptation of the UBM 504 producing an adapted UBM. The adapted UBM is generated by adapting the UBM 504 parameters according to the features that are extracted from the audio signal in local RT-buffer 500. The adaptation process of the UBM 504 is similar to the adaptation process performed on steps 412 and 422 of FIG. 4. The data structure of the adapted UBM is similar to the data structure of the UBM 504. The data structure of the UBM 504 and the adapted UBM is illustrated at FIG. 3B.

Step 508 discloses adapted statistical data extraction from the adapted UBM produced on step 506. The adapted statistical data extraction is performed similarly to the extraction of a single neutral adapted statistical data on step 414 of FIG. 4 and also similarly to the extraction of a single emotion adapted statistical data on step 424 of FIG. 4

In some embodiments the adapted statistical data is extracted by extracting the adapted Gaussian means from the adapted UBM that is produced on step 506 thus producing a means vector.

Step 510 discloses emotion classification of the adapted statistical data that is extracted on step 508. The adapted statistical data is fed to a classification system as input. Classification is preferably performed using methods such as neural networks or Support Vector Machines (SVM). For example, an SVM classifier may get the adapted statistical data and use the emotion classification model 512 that is generated on emotion classification model generation step 430 of FIG. 4. The emotion classification model may consist of support vectors, which are selected neutral adapted statistical data and emotion adapted statistical data that were fed to the system along with their class labels, "neutral speech" and "emotional speech", in the emotion classification model generation step 430 of FIG. 4. The SVM classifier may use the support vectors that are stored in the emotion classification model 512 in order to determine the distance between the adapted statistical data in its input and the "emotional speech" class. This distance measure is a scalar in the range of 0-100. It is referred to herein as the RT-buffer emotion score which is the output of this step. The RT-buffer emotion score represents probability estimation that the speaker that produced the speech in Local RT-buffer 500 is in an emotional state. High score represents high probability that the speaker that produced the speech in Local RT-buffer 500 is in an emotional state, whereas low score represents low probability that the speaker that produced the speech in Local RT-buffer 500 is in an emotional state.

Step 514 discloses storing the RT-buffer emotion score, which is produced on step 512, in an emotion flow vector. The emotion flow vector stores a sequence of RT-buffer emotion scores from the beginning of the audio interaction until present time.

Step 516 discloses deciding whether to generate an emotion detection signal or not. The decision may be based on detecting a predefined pattern in the emotion flow vector. The pattern may be, for example, a predefined number of consecutive entries in the emotion flow vector that contain scores that are higher than a predefined threshold. Assuming, in this example, that the predefined number is three and the predefined threshold is 50. In this case, if three consecutive entries contain scores that are higher than 50 an emotion detection signal is generated.

In other embodiments, the decision whether to generate an emotion detection signal or not may be based on global emotion score. The global emotion score may be a mathematical function of RT-buffer emotion scores that are stored in the emotion flow vector. The global emotion score may be, for example, the mean score of all RT-buffer emotion scores that are stored in the emotion flow vector. The global emotion score may also take into account the number of consecutive entries that contain scores that are higher than a first predefined threshold. The emotion detection signal may be generated in case that the global emotion score is higher than a second predefined threshold.

The emotion detection signal may be used for issuing an emotion alert to a contact center representative or a contact center supervisor or a contact center manager that an emotional interaction is currently taking place. In case that emotion alert is issued, the contact center supervisor may be able to listen the interaction between the customer and the contact center representative. Upon listening, the contact center supervisor may estimate, in real time, the cause of the emotions expressed by the customer. The contact center supervisor may also estimate, in real time, whether the contact center representative is able to handle the situation and ensure the customer's satisfaction. Depending on these estimations, the contact center supervisor may choose to intervene in the middle of the interaction and take over the interaction, replacing the contact center representative in order to handle the emotional interaction and ensure the customer's satisfaction. The contact center supervisor may also choose to transfer the interaction to another contact center representative, aiming to raise the probability of the customer's satisfaction.

Reference is made to FIG. 6A which shows a means vector data structure according to exemplary embodiments of the disclosed subject matter. The means vector data structure that is shown in FIG. 6A may be generated by neutral adapted statistical data extraction step 414 of FIG. 4, by emotion adapted statistical data extraction step 424 of FIG. 4 or by adapted statistical data extraction step 508 of FIG. 5. The means vector is generated by extracting and concatenating the means of the Gaussians of a GMM. The means vector contains P concatenated Gaussian means, where P may typically be 256. Each Gaussian mean typically include 33 mean entries, where each entry represents the mean of a different MFC coefficient, delta MFC coefficient and delta-delta MFC coefficient.

Reference is made to FIG. 6B which shows an emotion flow vector data structure according to exemplary embodiments of the disclosed subject matter. The emotion flow vector accumulates the RT-buffer emotion score. Each entry of the emotion flow vector represents one RT-buffer emotion score. Each entry on the ordinal RT-buffer row 600 which is the upper row of the data structure table represents the ordinal number of the RT-buffer. Each entry on the RT-buffer emotion score row 602 represents the RT-buffer emotion score that was generated by emotion classification step 510 of FIG. 5. Each entry on the time tags row 604 represents the start time and end time of the RT-buffer in with respect to the interaction. For example, as shown by fields 606 and 608 the RT-buffer emotion score of the $2^{nd}$ RT-buffer is 78. As further shown by field 610 the $2^{nd}$ RT-buffer start time is 4001 milliseconds from the begging of the interaction and the $2^{nd}$ RT-buffer end time is 8000 milliseconds from the begging of the interaction.

Figure 7:
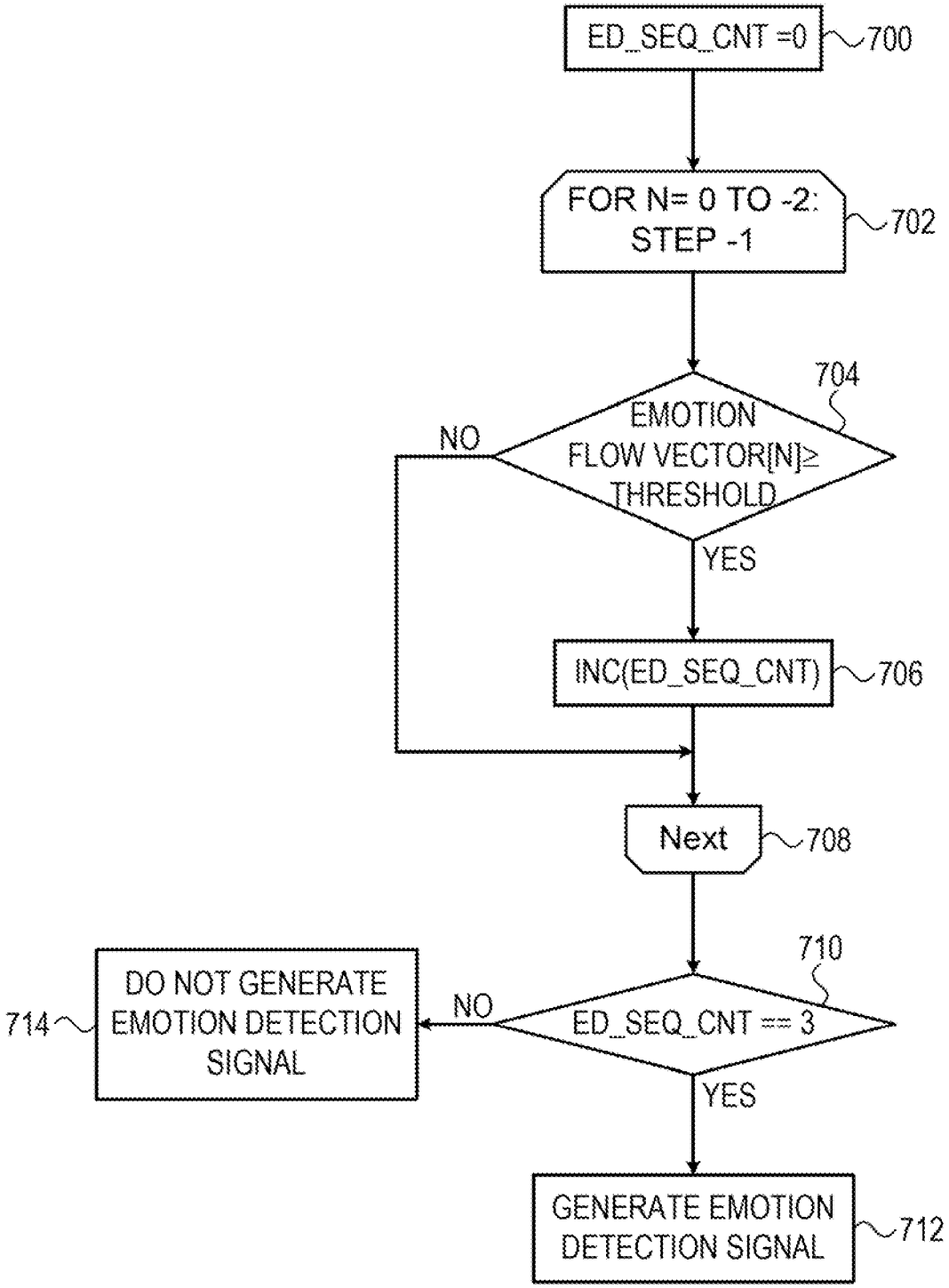
FIG. 7 shows a method of real time emotion decision according to embodiments of the disclosed subject matter.

Reference is made to FIG. 7 which shows a method of real time emotion decision according to embodiments of the disclosed subject matter. FIG. 7 may represent real time emotion decision as indicated at step 516 of FIG. 5.

Step 700 discloses the resetting of ED_SEQ_CNT. ED_SEQ_CNT is a counter that counts the number of emotion flow vector entries that include values that are higher than a predefined threshold.

Step 702 discloses initiating an iteration process. The iteration process counter is the parameter N. The parameter N iterates from zero to minus two in steps of minus 1.

Step 704 discloses comparing the value of the N'th entry of the emotion flow vector to a predefined threshold. The emotion flow vector is a sequence of RT-buffer emotion scores from the beginning of the audio interaction until present time. The most recent entry in the emotion flow vector represents the most recent RT-buffer emotion score. The ordinal number that represents this most recent entry is zero. The ordinal number that represents the entry prior to the most recent entry is minus one, and so forth. In case that the N'th entry of the emotion flow vector is higher or equal to the predefined threshold than as disclosed at step 706 the ED_SEQ_CNT is incremented. In case that the N'th entry of the emotion flow vector is lower than a predefined threshold than the ED_SEQ_CNT is not incremented. A typical value of the predefined threshold may be 50.

As indicated at steps 708 and 702, the process repeats for the three most recent emotion flow vector entries. Entry zero, entry minus on and entry minus two.

Step 710 discloses comparing the ED_SEQ_CNT to three. In case that ED_SEQ_CNT equals three then, as disclosed by step 712, an emotion detection signal is generated. In any other case, as disclosed by step 714, emotion detection signal is not generated.

In practice, according to this disclosed exemplary process, an emotion detection signal is generated in case that all of the most recent three entries of the emotion flow vector contain RT-buffer emotion scores that are higher than the predefined threshold.

Figure 8:
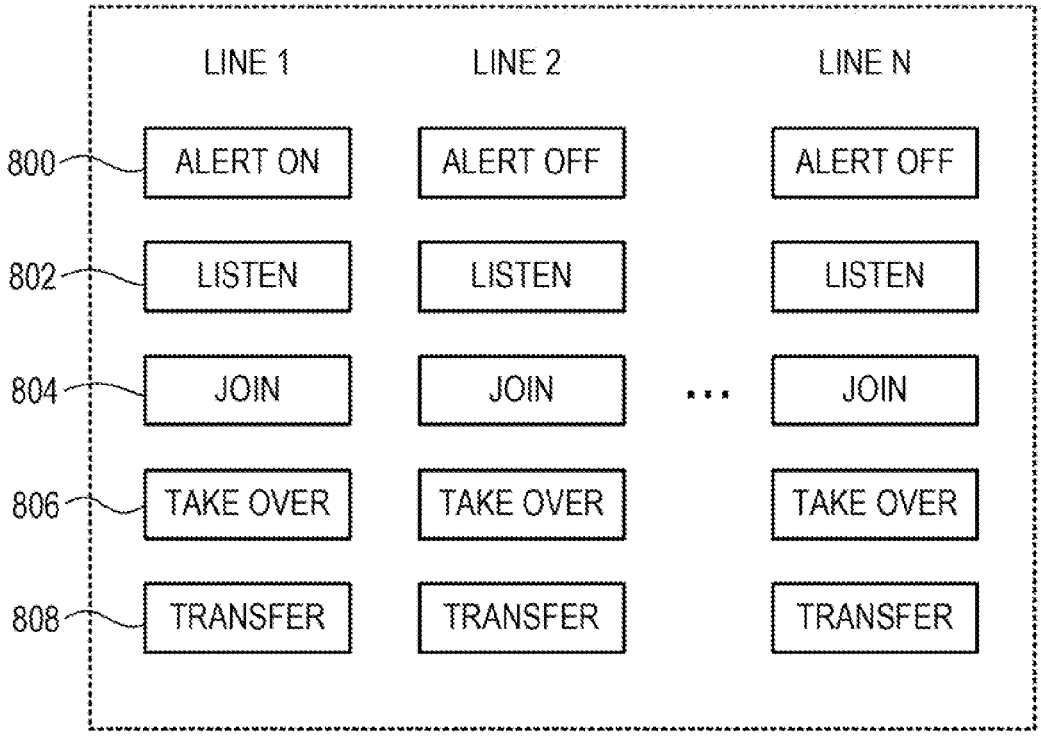
FIG. 8 shows an exemplary illustration of an application of real time emotion detection according to embodiments of the disclosed subject matter.

Reference is made to FIG. 8 which shows an exemplary illustration of an application of real time emotion detection according to embodiments of the disclosed subject matter. The figure illustrates a screen that may be part of a contact center supervisor or contact center manager application. The contact center supervisor or contact center manager may be able to see whether an emotion alert is on or off for each line and act accordingly. Each line may be a telephone line or other vocal communication channel that is used by an organization representative, such as voice over IP channel. The emotion detection alert is generated based on the emotion detection signal that is generated on step 516 of FIG. 5. As shown, the emotion alert indicator 800 of line 1 is on. The contact center supervisor or contact center manager may, choose to listen to the interaction taking place in line 1, by pressing button 802, intervene in the middle of the interaction, by pressing button 804, and take over the interaction, by pressing button 806, or transfer the interaction to another organization representative, by pressing button 808.

Figure 9:
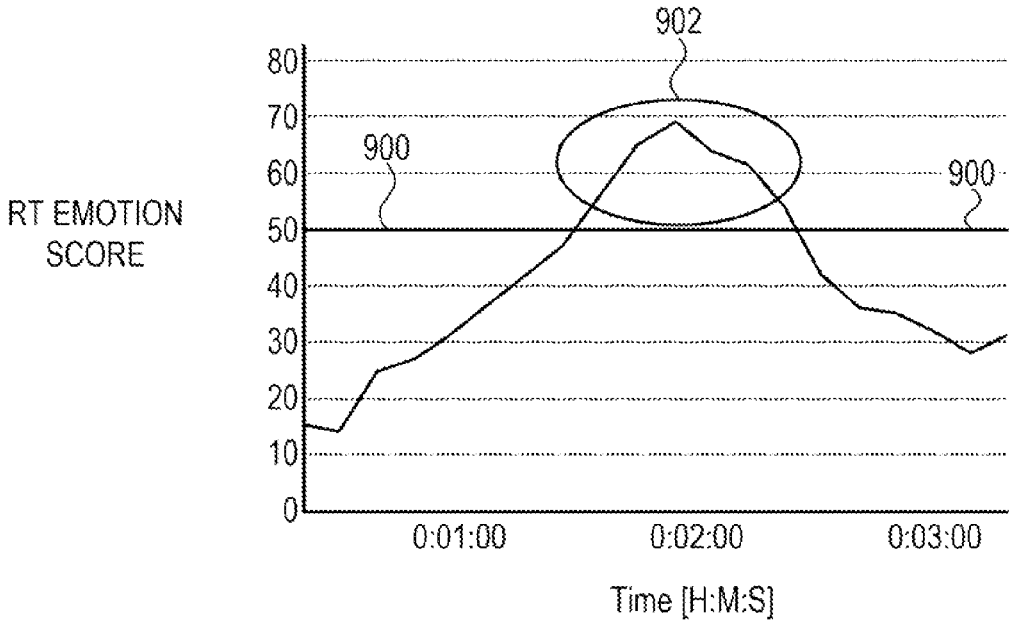
FIG. 9 shows an exemplary illustration of real time emotion detection score displaying application according to embodiments of the disclosed subject matter.

Reference is made to FIG. 9 which an exemplary illustration of real time emotion detection score displaying application according to embodiments of the disclosed subject matter. The figure illustrates a real time emotion score curve which may be a part of a contact center supervisor or contact center manager application screen. The real time emotion score curve may be plotted as the interaction is taking place, in real time. Each point of the real time emotion score curve may represent the RT-buffer emotion score, generated on step 510 of FIG. 5. The X axis of the graph represents the time from the beginning of the interaction, whereas the X axis of the graph represents the RT-buffer emotion. Line 900 may represent the predefined threshold that is used in step 516 of FIG. 5. Area 902 represents a sequence of RT-buffer emotion scores that are higher than the predefined threshold. The application may be able to present a plurality of real time emotion score curves, one curve per telephone line or other vocal communication channel that is used by an organization representative.

The contact center supervisor or contact center manager may choose to listen to the interaction and make decisions based on the real time emotion score curve and/or on the emotion detection signal that is generated on step 516 of FIG. 5.

Figure 10:
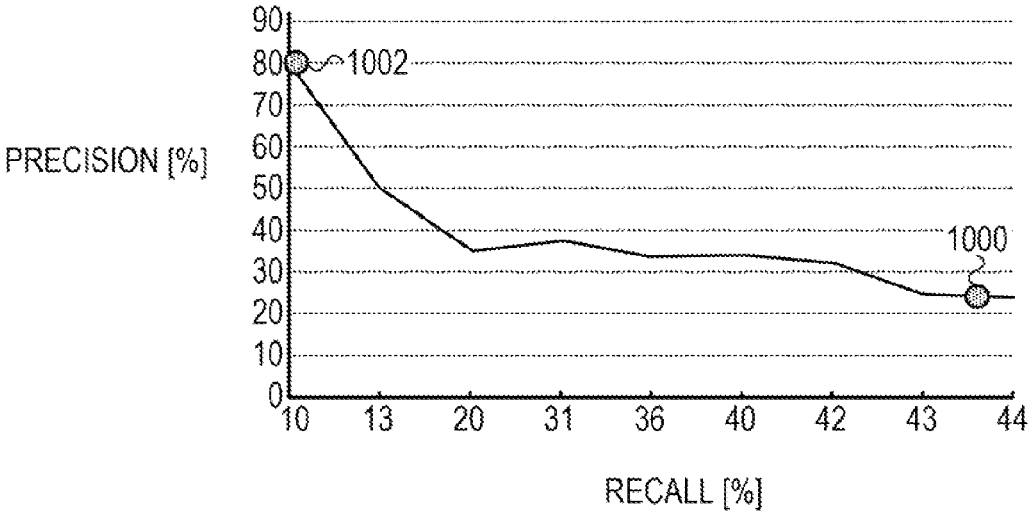
FIG. 10 shows an emotion detection performance curve in terms of precision and recall according to exemplary embodiments of the disclosed subject matter.

Reference is made to FIG. 10 which shows an emotion detection performance curve in terms of precision and recall according to exemplary embodiments of the disclosed subject matter. The performance curve that is shown is produced by testing the disclosed RT emotion detection method on a corpus of 2088 audio interactions. 79 out of the 2088 audio interactions include emotional speech events. In the test, each audio interaction was divided to RT-buffers. As disclosed at step 510 of FIG. 5, an RT-buffer emotion score was produced for each RT-buffer of each interaction. The curve was produced by calculating the precision and recall percentages for each RT-buffer emotion score level. The RT-buffer emotion score level is in the range of 0-100. For example point 1000, which is the right most point on the curve correspond to emotion score level of 0. The calculated precision in point 1000 is 24% whereas; the calculated recall at this point is 44%. On the other hand point 1002 which is the left most point on the curve to emotion score level of 100. The calculated precision in point 1002 is 80% whereas; the calculated recall at this point is 11%.

What is claimed is:

1. A computerized method for real time emotion detection in audio interactions comprising:

receiving at a computer server a portion of an audio interaction between a customer and an organization representative, the portion of the audio interaction comprises a speech signal;

extracting feature vectors from the speech signal by extracting Mel-Frequency Cepstral Coefficients and their derivatives from the speech signal;

obtaining a statistical model;

producing adapted statistical data by adapting the statistical model according to the speech signal using the feature vectors extracted from the speech signal;

obtaining an emotion classification model; and producing an emotion score based on the adapted statistical data and the emotion classification model, said emotion score represents the probability that the speaker that produced the speech signal is in an emotional state.

2. The method according to claim 1, further comprises storing the emotion score in an emotion flow vector, said emotion flow vector stores a plurality of emotion scores over time;

generating an emotion detection signal based on the plurality of emotion scores stored in the emotion flow vector; and issuing an emotion alert to a contact center employee based on the emotion detection signal while the audio interaction is in progress.

3. The method according, to claim 2 wherein the generation of the emotion detection signal is based on detection of predefined patterns in the plurality of emotion scores stored in the emotion flow vector.

4. The method according to claim 2 wherein the generation of emotion detection signal is based on a mathematical function that is applied on the stored emotion scores.

5. The method according to claim 1, wherein the adapted statistical data is produced by extracting, a means vector from the adapted statistical model.

6. The method according to claim 1, further comprises displaying the plurality of emotion scores stored in the emotion flow vector while the audio interaction is in progress.

7. The method according to claim 1 wherein said statistical model is a statistical representation of a plurality of feature vectors extracted from a plurality of audio interactions.

8. The method according to claim 1 wherein said emotion classification model generation comprises:

obtaining a plurality of audio interactions;

associating each portion of each one of the plurality of audio interactions with a first class or with a second class;

extracting a plurality of feature vectors from the plurality of audio interactions;

obtaining the statistical model;

generating a plurality of first adapted statistical models by adapting the statistical model using the plurality of feature vectors that are extracted from the portions that are associated with the first class;

generating a plurality of second adapted statistical models by adapting the statistical model using the plurality of feature vectors extracted from the portions that are associated With the second class;

producing a plurality of first adapted statistical data from the plurality of the first adapted statistical models;

producing a plurality of second adapted statistical data from the plurality of the second adapted statistical models; and generating the emotion classification model based on the plurality of first adapted statistical data and the plurality of second adapted statistical data.

9. The method according to claim 8 wherein extracting a plurality of feature vectors from the plurality of audio interactions comprises extracting Mel-Frequency Cepstral Coefficients and their derivatives from the plurality of audio interactions.

10. The method according to claim 8 wherein generating each one of the plurality of the first adapted statistical models and generating each one of the plurality of the second adapted statistical models is based on maximum a posteriori probability adaptation.

11. The method according to claim 8 wherein the plurality of first adapted statistical data is produced by extracting the means vectors from the plurality of first adapted statistical models.

12. The method according to claim 8 wherein the plurality of second adapted statistical data is produced by extracting the means vectors from the plurality of second adapted statistical models.

13. A computerized method for real time emotion detection in audio interactions comprising:

receiving at a computer server a portion of an audio interaction between a customer and an organization representative, the portion of the audio interaction comprises a speech signal;

extracting feature vectors from the speech signal;

obtaining a statistical model;

producing adapted statistical data by adapting the statistical model according to the speech signal using the feature vectors extracted from the speech signal;

obtaining an emotion classification model;

producing an emotion score based on the adapted statistical data and the emotion classification model, said emotion score represents the probability that the speaker that produced the speech signal is in an emotional state;

storing the emotion score in an emotion flow vector, said emotion flow vector stores a plurality of emotion scores over time;

generating an emotion detection signal based on the plurality of emotion scores stored in the emotion flow vector and on detection of predefined patterns in the plurality of emotion scores stored in the emotion flow vector; and issuing an emotion alert to a contact center employee based on the emotion detection signal while the audio interaction is in progress.

14. A computerized method for real time emotion detection in audio interactions comprising:

receiving at a computer server a portion of an audio interaction between a customer and an organization representative, the portion of the audio interaction comprises a speech signal;

extracting, feature vectors from the speech signal;

obtaining a statistical model;

producing adapted statistical data by adapting the statistical model according to the speech signal using the feature vectors extracted from the speech signal;

obtaining an emotion classification model;

producing an emotion score based on the adapted statistical data and the emotion classification model, said emotion score represents the probability that the speaker that produced the speech signal is in an emotional state;

storing the emotion score in an emotion flow vector, said emotion flow vector stores a plurality of emotion scores over time;

generating an emotion detection signal based on a mathematical function that is applied on the stored emotion scores; and issuing an emotion alert to a contact center employee based on the emotion detection signal while the audio interaction is in progress.

15. A computerized method for real time emotion detection in audio interactions comprising:

receiving at a computer server a portion of an audio interaction between a customer and an organization representative, the portion of the audio interaction comprises a speech signal;

extracting feature vectors from the speech signal;

obtaining a statistical model;

producing adapted statistical data by adapting, based on a maximum a posteriori probability adaptation, the statistical model according to the speech signal using the feature vectors extracted from the speech signal;

obtaining an emotion classification model; and producing an emotion score based on the adapted statistical data and the emotion classification model, said emotion score represents the probability that the speaker that produced the speech signal is in an emotional state.

16. A computerized method for real time emotion detection in audio interactions comprising:

receiving at a computer server a portion of an audio interaction between a customer and an organization representative, the portion of the audio interaction comprises a speech signal;

extracting, feature vectors from the speech signal;

obtaining a statistical model;

producing adapted statistical data by adapting the statistical model according to the speech signal using the feature vectors extracted from the speech signal;

obtaining an emotion classification model by operations that comprise:

obtaining a plurality of audio interactions;

associating each portion of each one of the plurality of audio interactions with a first class or with a second class;

extracting a plurality of feature vectors from the plurality of audio interactions;

obtaining the statistical model;

generating a plurality of first adapted statistical models by adapting the statistical model using the plurality of feature vectors that are extracted from the portions that are associated with the first class;

generating a plurality of second adapted statistical models by adapting the statistical model using the plurality of feature vectors extracted from the portions that are associated with the second class;

producing a plurality of first adapted statistical data from the plurality of the first adapted statistical models;

producing a plurality of second adapted statistical data from the plurality of the second adapted statistical models;

generating the emotion classification model based on the plurality of first adapted statistical data and the plurality of second adapted statistical data; and the method further comprising producing an emotion score based on the adapted statistical data and the emotion classification model, said emotion score represents the probability that the speaker that produced the speech signal is in an emotional state.

* * * * *